United States Patent [19]

Barkley

[11] 3,984,096

[45] Oct. 5, 1976

[54] APPARATUS FOR FEEDING LETTERS

[76] Inventor: Ronald A. Barkley, 32 Grenfell Crescent, Ottawa, Ontario, Canada, K2G 0G2

[22] Filed: Oct. 29, 1974

[21] Appl. No.: 518,907

[30] Foreign Application Priority Data

Oct. 29, 1973 United Kingdom ..... 50144/73

[52] U.S. Cl. ..... 271/129; 271/139

[51] Int. Cl.[2] ..... B65H 3/02; B65H 5/16

[58] Field of Search ..... 271/42, 129, 137–140, 271/149, 150

[56] References Cited

UNITED STATES PATENTS

| | | | |
|---|---|---|---|
| 2,187,123 | 1/1940 | Harm | 271/140 |
| 2,707,569 | 5/1955 | Benson | 271/42 |
| 3,726,590 | 4/1973 | Kistner et al. | 271/129 |

*Primary Examiner*—Evon C. Blunk
*Assistant Examiner*—Robert Saifer
*Attorney, Agent, or Firm*—Beveridge, DeGrandi, Kline & Lunsford

[57] ABSTRACT

A method and apparatus for feeding letters from a relatively loose stack of letters, in which each successive end letter in the stack is subjected to repeated impulses applied by a rapidly reciprocating friction surface which moves in a direction having components of movement both transverse to and parallel to the plane of the end letter. The movement is sufficiently rapid that the inertia of the leading letter to movement transverse to its plane substantially increases the pressure between the friction surface and the leading letter as compared with the pressure between that letter and the next in the stack. The friction surface is preferably a relatively uncompressible pad which is moved with an elliptical motion to repeatedly strike the end letter at a speed between 1,000 and 10,000 cycles per minute.

12 Claims, 2 Drawing Figures

APPARATUS FOR FEEDING LETTERS

Figure 1:
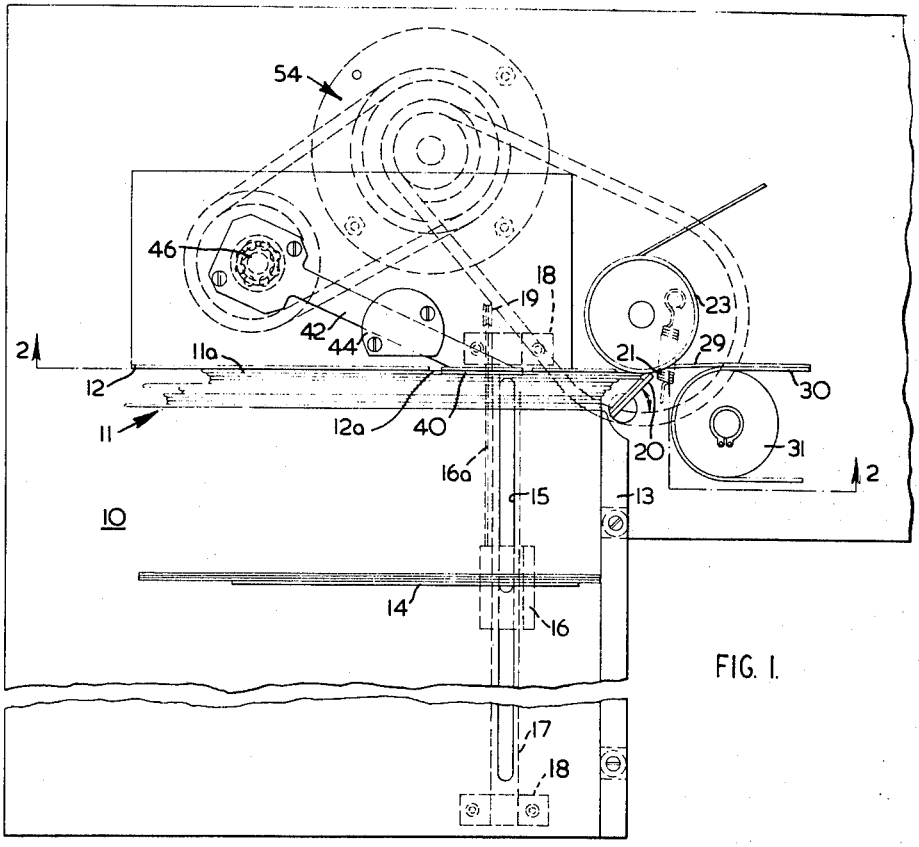

The present invention relates to a device primarily for feeding enveloped mail. Although the invention operates best on enveloped mail, and the term "letters" as used herein will be understood to mean letters in envelopes, the invention will work successfully with the normal mixture of mail, including cards, processed in a post office.

Letter handling apparatus generally incorporates a feeding device for feeding the letters one-by-one from a stack of the letters. Simple feeding devices use a belt of high friction material which contacts the surface of a letter at the end of the stack and slides this over the next adjacent letter to a position in which rollers or belts can contact both of its surfaces and move it away for further processing.

Simple devices which rely solely on the friction of a slowly moving belt against a letter, although providing reasonable performance, do not always provide adequate force to get the letter moving, particularly if this tends to stick against the next adjacent letter. This draw-back has led to the use of suction devices whereby suction draws the letter against the friction belt. Suction devices however have the disadvantage of added complexity, weight and space, this being particularly important where the device is intended to be portable. Also, the suction devices can generate a fair amount of noise, and in addition the suction devices may pick up more than one article at a time if these are slightly porous, as with thin single thickness mail pieces.

The present invention provides a method and apparatus for feeding letters from a stack which does not use suction and yet which increases the friction forces between the letter and the feeding means so as to give a reliable feed even with letters which tend to stick in the stack.

In accordance with one aspect of the invention, there is provided a process for feeding enveloped mail one at a time to a delivery point, comprising forming a relatively uncompressed stack of said mail, and subjecting each successive end letter in the stack to repeated impulses applied by a rapidly reciprocating friction surface which moves against the outer surface of said end letter in a direction having components of movement both transverse to and parallel to the plane of said end letter, the movement of said friction surface transverse to the end letter and towards the stack having a maximum velocity such that said end letter is laterally accelerated towards the remainder of the stack by the friction surface substantially more than the next underlying letter in the stack, whereby the maximum transverse force between the friction surface and the end letter is substantially more than the maximum transverse force between the inner surface of said end letter and the next underlying letter.

The reciprocating motion of the friction surface towards and away from the letters occurs at a relatively fast rate, so that the inertial resistance of the end letter to movement transverse to its plane gives a much higher force between the friction surface and the end letter than that produced merely by the pressure applied to the rear end of the stack towards the feeding device. This higher force increases the friction between the feeding means and the end letter in the desired way, without the use of vacuum. The letters in the stack behind the end letter are less affected by the reciprocating movement of the feeding means by reason of the looseness of the stack, and the frictional forces between the end letter and the next adjacent letter are not increased very much: this means that the feeding force on the end letter is significantly increased without much increase in the retarding frictional force between this letter and the next adjacent letter. Also, the constant motion of the end letters in the stack helps to free any letters which would otherwise become snagged on letters underneath.

The term "relatively uncompressed" means that the envelopes in the stack are subjected to a compression force which compresses the envelopes only by a minor proportion of the total compression possible; such a relatively uncompressed state being produced by a force of ¼ to 3 lb. on the stack.

Applicant is aware of one prior proposal for feeding single sheets of paper (specifically cheques) by a vibrating feeder, as described in U.S. Pat. No. 2,668,706 to Benson, which issued Feb. 9, 1954. In the Benson patent, an electromagnetically vibrated soft rubber pad acts on the top cheque of a pile and feeds the top cheque into a sorting device. In Benson however the vibrating feeder does not operate to laterally accelerate the leading cheque (as the end letter is accelerated in this invention), since the soft rubber pad would deform against Benson's relatively solid vertical stack of cheques. Thus Benson does not suggest some essentials of the process of this invention, particularly laterally accelerating an item to be fed, so that the transverse force applied to its leading surface is greater than that applied to its opposite surface by the underlying item.

U.S. Pat. No. 3,827,553, which issued in Aug., 1974 to Cross, also shows a vibrating feeder, but this deals with a different problem from that of feeding an end letter from a stack, and does not suggest forming an uncompressed stack of items.

In accordance with another aspect of the present invention, apparatus for feeding letters from a stack comprises feeding means having a relatively uncompressible friction surface arranged to contact the outer surface of the end letter in the stack, and driving means for imparting to the feeding means a rapid reciprocating motion having a component towards and away from the letter, and a component of movement parallel to the plane of the letter, such that the feeding means move in a selected direction along the plane of the letter simultaneously with moving towards the letter, and frictionally move the letters in said selected direction. The relatively incompressible friction surface ensures that the end letter is moved laterally as well as in its own plane; the friction surface must be uncompressible enough so that its outer surface, which contacts the end letter, moves the letter by an amount considerably greater than any compression in the friction pad.

The frequency of reciprocating motion of the feeding means should preferably be greater than the resonant frequency of the letter stack. In practice, a frequency between 1,000 and 3,000 cycles per minute has been found satisfactory for most letters, although it is believed that frequencies up to 10,000 rpm (with a short stroke) should work well. The stroke of the feeding means, in the direction perpendicular to the letters, may be roughly of the order between 1/20 of an inch (for the fastest movement) and ¼ of an inch for the slowest frequency.

In a preferred embodiment the friction surface operates with an aperture in a plate which supports the end of the letter stack adjacent the feeding means; and in the most withdrawn position of the feeding means the friction surface is out of contact with the end letter. In this case, it is not absolutely necessary for the frequency of reciprocation of the feeding means to be higher than the natural frequency of the stack.

Figure 2:
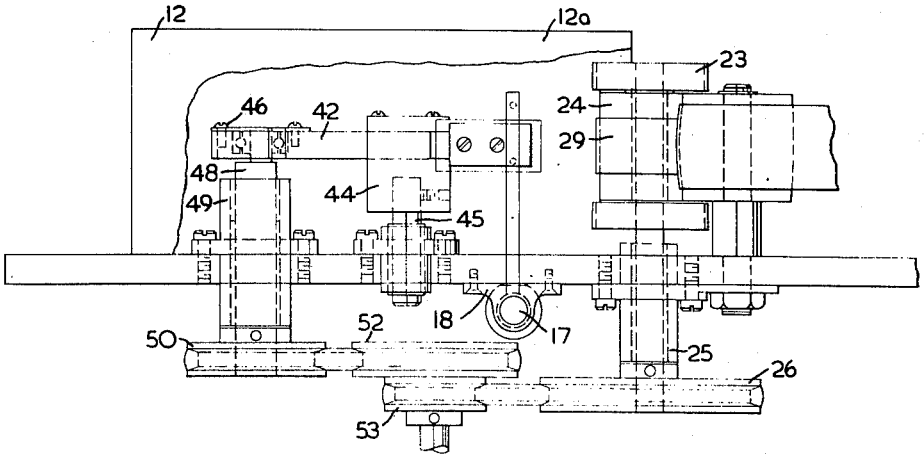

A preferred embodiment of the invention will now be described with reference to the accompanying drawings, in which:

FIG. 1 is a plan view of a letter feeding device in accordance with the invention, and FIG. 2 is an elevation view of the device on lines 2—2 of FIG. 1, The drawing shows a feeding device including a horizontal plate 10 which supports the lower edges of the letters 11, allowing these to slide along easily, this base plate supporting a vertical plate 12 which forms an end stop for the stack of letters, and the letters in the major portion of the stack have one of their side edges located by a side wall 13. The stack is urged towards the plate 12 by a movable vertical plate 14 which is mounted on a bar extending down through slot 15 in the plate 10 and carried by a bearing member 16 slidable on a shaft 17 which extends perpendicularly to plate 12, and which is supported close to the bottom of plate 10 by bearings 18. A flexible element **16*a* passes from the member 16 to a pulley 19, also mounted under the plate 10, and the lower end of this member 16*a* carries a weight which subjects the plate 14 to a force of between one quarter pound and three pounds. The plate 12 has an aperture 12*a* shown in FIG. 2**.

Between the end of wall 13 and the plate 12 a gap is provided to allow letters 11 to pass out individually between a doubles rejection gate 20, pressed against the letters by a spring 21, and a slow turning high friction surface roller having two friction surfaces 23 separated by a pulley portion 24. This roller has a vertical spindle passing through a bearing 25 carried by base plate 10 and having a pulley 26 at its lower end. The pulley surface 24 carries a belt 29, and this cooperates with a further belt 30 held by pulley 31 to provide pinch belt means moving the letters when they have passed the doubles rejection gate 20. These items are of a generally conventional construction.

The feeding means in accordance with the invention comprises a high friction pad 40 held on the end of a reciprocating arm 42 which extends away from the pad 40 at an oblique angle of about 25°, and which holds the pad disposed within the aperture **12*a*. The high friction pad 40 is formed of a rubberized belting material which is relatively uncompressible in the lateral direction as compared to the overall compressibility of the stack of letters held between plates 12 and 14. The arm 42 is supported at a position intermediate its ends by a slide way formed in a rocking member 44 rotatable on vertical spindle 45 and which allows simultaneous axial sliding of arm 42, and rocking about a vertical axis intermediate its ends. The outer end of arm 42 is moved in a circular path by eccentric 46, which is mounted on a vertical spindle 48 held in bearing 49, and which carries at its lower end, below the plate 10, a pulley 50. Pulleys 50 and 26, driving respectively the eccentric 46 and the roller 23, are connected by belts to pulleys 52 and 53 carried by the spindle of an electric motor indicated at 54 in FIG. 1**.

Since the member 44 is closer to the pad 40 than to the eccentric 46, the rotation of the eccentric causes the pad 40 to move along an elliptical path which has a major axis coinciding with that of the arm 42. The direction of rotation of the eccentric 46 is clockwise in the plan view as shown, so that the elliptical motion of the pad 40 is in an anti-clockwise direction. The outer face of pad 40, during this movement, passes through a plane which is continuation of the face of plate 12 facing the letters, so as to strike the end letter held by the plate 12. With the elliptical motion described, the pad 40 strikes the leading letter **11*a* at an instant when the pad is moving obliquely to the letter surface in a direction having a component toward the roller 23 as well as towards the letter surface, and the inertial resistance of the letter to the lateral movement ensures that at this instant there is a high normal force between the pad and the letter, and thus a high frictional force for feeding the letter. The manner in which the pad strikes the letter is partly determined by arranging that the pad passes through the plane of the front surface of plate 12, and with this arrangement the pad can be made to strike the leading letter when moving in a suitable direction, irrespective of its speed. However, it is preferred to use a speed of reciprocation of the pad which is higher than the natural frequency of reciprocation of the leading letter in the stack, and this also helps to ensure that there is proper impact between the pad and the letter, and that the pad clears the letter in its return path. The elliptical path of motion of the pad will be such that most of the movement of the pad towards the letter occurs along the portion of the ellipse contained in the acute angled area between the leading letter 11*a* and the major axis of the elipse. With the design as shown, good results are achieved with an eccentric stroke of 3/16 of an inch (giving total movement of pad 40** perpendicular to the letter slightly less than 3/16 of an inch), and with a speed of reciprocation of 1100 cycles per minute.

The leading letter is moved by the pad 40 in a ratchet type manner until it reaches the wedge between the gate 20 and the roller 23. The surface of roller 23 has a higher coefficient of friction than that of gate 20, so the balance of forces on the letter are such that it continues to move at the rate of the slow rotating roller over the gate 20, even if the doubles rejection force is fairly high. The frequency of the reciprocating arm, and the rotational speed of the slow turning roller 23 control the spacing between letters. Due to the relatively uncompressed nature of the stack of letters, this does not move as a unit but rather as a series of small masses interconnected by springs (due to the springiness of the envelopes caused both by their compressibility and in many cases their lack of flatness), and a letter in the stack is not acted on significantly by the reciprocating pad until the pad is in direct contact with it.

The possibility of letters becoming snagged one on the other is minimized in this apparatus firstly by the high feeding force given to the leading letter by the pad, and secondly by the constant vibration in the stack which tends to loosen the letters. In order to ensure that the letters do not have to be compressed in order to be delivered properly to the feeding pad 40, it is preferred to use vibrating members to support the stack itself above the level of the base plate 10. Suitable supporting members, which are not shown, extend in the direction of movement of letters in the stack towards the plate 12, and these members are continuously vibrated at a frequency high enough to give intermittent contact with the lower edges of the letters, and this ensures that the stack can be moved very easily towards the feeding pad 40, with a minimum of force being applied by the plate 14.

In another successful embodiment of the type described, a variety of thin flat articles including cards of thickness of 5/1000ths of an inch, and letters up to ¼ inches thick, and of standard sizes (3½ inches by 5½ inches and 5⅞ inches by 10 inches) were fed successfully using an eccentric 26 with a stroke of ⅛ inch, rotating at a speed of 2000 r.p.m. Eccentric speeds in the range of 1,000 to 3,000 r.p.m. have been found to give satisfactory results.

Various other mechanisms for producing the reciprocating motion of the feeding means may be used. One such mechanism is similar to that described, except that the arm holding the pad is mounted for axial movement only, without any rocking motion, being moved by a crank and connecting rod mechanism. In this case, the feeding means merely moves with straight line motion, at an oblique angle to the letter. Although satisfactory, this mechanism did not give results as good as those of the mechanism shown in the drawing.

Another arrangement which has been tried in practice is the use of a conventional high friction belt, contacting the leading letter, the belt being reciprocated towards and away from the letter by means of a cam rotatable at high speed and arranged to repeatedly strike the surface of the belt opposite to that contacting the letter.

It is also envisaged that the feeding means may be reciprocated by an electro-magnet to which alternating current is applied.

The feeding means in accordance with this invention are not confined to the feeding of letters held in a vertical plane, but may be used for letters disposed horizontally and stacked on a vertical stack.

The embodiments of the present invention in which an exclusive property or privilege is claimed are defined as follows:

1. A process for feeding enveloped mail one at a time to a delivery point, comprising forming a horizontal stack of said mail, the letters of said stack having their major surfaces substantially vertical, said stack being compressed to only a minor proportion of the total possible compression, and subjecting each successive end letter in the stack to repeated impulses applied by a reciprocating friction surface which moves against the outer surface of said end letter in a direction having components of movement both transverse to and parallel to the plane of said end letter, the movement of said friction surface transverse to the end letter and towards the stack having a maximum velocity such that said end letter is laterally accelerated towards the remainder of the stack by the friction surface substantially more than the next underlying letter in the stack, whereby the maximum transverse force between the friction surface and the end letter is substantially more than the maximum transverse force between the inner surface of said end letter and the next underlying letter.

2. A process according to claim 1, wherein the outer end of the stack remote from the friction surface is subjected to a compressive force of between ¼ pound and 3 pounds.

3. A process according to claim 1, wherein the stroke of the friction surface in the direction perpendicular to the plane of the letters is between 1/20 and ¼ of an inch.

4. A process according to claim 1, wherein the frequency of reciprocation of the feeding means is between 1,000 and 10,000 cycles per minute.

5. Apparatus for feeding enveloped mail one at a time towards a delivery point, comprising feeding means, a generally horizontal plate suitable for supporting a horizontal stack of said mail, means horizontally aligned with said feeding means for subjecting the end of said stack remote from the feeding means to a compressive force of between ¼ and 3 pounds, whereby said stack is compressed to only a minor proportion of the total possible compression, said feeding means having a friction surface arranged to contact the outer surface of that end letter in the stack adjacent the feeding means, said friction surface being relatively uncompressible compared to the compressibility of said stack, and driving means for imparting to the feeding means a rapid reciprocating motion having a frequency of reciprocation of between 1,000 and 10,000 cycles per minute, and having a component towards and away from the end letter, and a component of movement parallel to the plane of the end letter, such that the feeding means move in a selected direction along the plane of the end letter simultaneously with moving towards the end letter, and frictionally move successive end letters in said selected direction.

6. Apparatus according to claim 5, wherein the stroke of said feeding means is between 1/20 and ¼ of an inch.

7. Apparatus for feeding enveloped mail one at a time towards a delivery point, comprising feeding means, a generally horizontal plate for supporting a stack of said mail, means for subjecting the end of said stack remote from the feeding means to a compressive force of between ¼ and 3 pounds, whereby said stack is compressed to only a minor proportion of the total possible compression, said feeding means having a friction surface arranged to contact the outer surface of that end letter in the stack adjacent the feeding means, said friction surface being relatively uncompressible compared to the compressibility of said stack, further comprising a generally vertical plate defining that end of the stack adjacent the feeding means, said vertical plate having an aperture through which said feeding means projects, said friction surface being movable through the plane which is a continuation of the surface of said vertical plate which faces the stack, and driving means for imparting to the feeding means a rapid reciprocating motion having a frequency of reciprocation of between 1,000 and 10,000 cycles per minute, and having a component towards and away from the letter, and a component of movement parallel to the plane of the letter, such that the feeding means move in a selected direction along the plane of the letter simultaneously with moving towards the letter, and frictionally move the letters in said selected direction.

8. Apparatus for feeding enveloped mail one at a time towards a delivery point, comprising means for supporting a stack of said mail in relatively uncompressed state, and feeding means having a relatively uncompressible friction surface arranged to contact the outer surface of the end letter in the stack, said feeding means being a flat pad mounted at the end of a reciprocating member, the reciprocating member being supported for axial sliding movement and simultaneous rocking movement about a transverse axis intermediate of its ends, the outer end of the member being moved in a circular path and driving means for moving the outer end of said member in a circular path, whereby the friction means has reciprocating motion with a component towards and away from the letter, and a component of movement parallel to the plane of the letter, such that the feeding means move in a selected direction along the plane of the letter simultaneously with moving towards the letter, and frictionally move the letters in said selected direction.

9. Apparatus according to claim 8 wherein said axis is nearer the pad than the outer end of the member.

10. A process for feeding enveloped mail one at a time to a delivery point, comprising forming a horizontal stack of said mail, the letters of said stack having their major surfaces substantially vertical, said stack being compressed to only a minor proportion of the total possible compression, and subjecting each successive end letter in the stack to repeated impulses applied by a reciprocating friction surface which moves against the outer surface of said end letter in a direction having components of movement both transverse to and parallel to the plane of said end letter, the frequency of reciprocation of the friction surface being sufficiently high relative to the inertia of the end letter that the friction surface clears the end letter during its movement away from the stack, and the movement of said friction surface transverse to the end letter and towards the stack having a maximum velocity such that said end letter is laterally accelerated towards the remainder of the stack by the friction surface substantially more than the next underlying letter in the stack, whereby the maximum transverse force between the friction surface and the end letter is substantially more than the maximum transverse force between the inner surface of said end letter and the next underlying letter.

11. A process according to claim 10, wherein the outer end of the stack remote from the friction surface is subjected to a compressive force of between ¼ pound and 3 pounds.

12. A process according to claim 10, wherein the stroke of the friction surface in the direction perpendicular to the plane of the letters is between 1/20 and ¼ of an inch.

* * * * *